United States Patent [19]

Arnold et al.

[11] Patent Number: 5,046,467

[45] Date of Patent: Sep. 10, 1991

[54] SYSTEM FOR SETTING THE THROTTLE FLAP ANGLE FOR AN INTERNAL COMBUSTION ENGINE

[75] Inventors: Herbert Arnold, Eberdingen; Michael Horbelt, Kleinglattbach; Rüdiger Jautelat, Tamm; Peter Werner, Wiernsheim; Manfred Mezger, Markgröningen; Günther Plapp, Filderstadt, all of Fed. Rep. of Germany

[73] Assignee: Robert Bosch GmbH, Stuttgart, Fed. Rep. of Germany

[21] Appl. No.: 452,408

[22] Filed: Dec. 19, 1989

Related U.S. Application Data

[63] Continuation-in-part of Ser. No. 202, Mar. 30, 1988, abandoned.

[30] Foreign Application Priority Data

Jun. 19, 1987 [DE] Fed. Rep. of Germany ..... 3720255

[51] Int. Cl.[5] ..... F02D 31/00

[52] U.S. Cl. ..... 123/339

[58] Field of Search ..... 123/339

[56] References Cited

U.S. PATENT DOCUMENTS

| | | | |
|---|---|---|---|
| 4,414,946 | 11/1983 | Däumer et al. | 123/417 |
| 4,452,200 | 6/1984 | Tsutsumi et al. | 123/339 |
| 4,453,518 | 6/1984 | Nakamura et al. | 123/339 |
| 4,474,151 | 10/1984 | Atago et al. | 123/339 |
| 4,508,076 | 4/1985 | Oda et al. | 123/339 |
| 4,580,220 | 4/1986 | Braun et al. | 123/339 |
| 4,584,645 | 4/1986 | Kosak | 123/417 |
| 4,611,560 | 9/1986 | Miyazaki et al. | 123/339 |
| 4,622,936 | 11/1986 | Junginger et al. | 123/399 |
| 4,629,907 | 12/1986 | Kosak | 307/265 |
| 4,763,623 | 8/1988 | Sasaki | 123/339 |
| 4,940,031 | 7/1990 | Mann | 123/339 |

*Primary Examiner*—Tony M. Argenbright
*Assistant Examiner*—Robert E. Mates
*Attorney, Agent, or Firm*—Walter Ottesen

[57] ABSTRACT

The invention is directed to a system for setting the throttle flap angle for an internal combustion engine. The system sets the idle stop for the idle throttle flap angle and monitors the setting with respect to defects that occur. If the throttle flap is in contact engagement with the idle stop, a contact is actuated which causes a buffer storage of the actual throttle flap angle which thereby represents the position of the idle stop. If then, for example, the idle stop changes during driving operation, its new position is established upon a renewed contact engagement of the throttle flap, by measuring the throttle flap angle. A possible defect can be established from a comparison of actual and desired values and a positioning motor is then appropriately driven to displace the idle stop. This system has the advantage that a defect occurring in the region of the positioning motor is detected without additional circuit complexity.

8 Claims, 2 Drawing Sheets

SYSTEM FOR SETTING THE THROTTLE FLAP ANGLE FOR AN INTERNAL COMBUSTION ENGINE

RELATED APPLICATIONS

This is a continuation-in-part application of our International patent application PCT/DE88/00202 filed in the German Patent Office on Mar. 30, 1988 with priority claimed from German patent application P 37 20 255.3 filed in the Federal Republic of Germany on June 19, 1987.

FIELD OF THE INVENTION

The invention relates to a system for setting the throttle flap angle for an internal combustion engine by means of an electronic control unit.

BACKGROUND OF THE INVENTION

For setting the throttle flap angle of an internal combustion engine, electronic control devices are used which vary the throttle flap angle as a function of the position of the accelerator pedal and of parameters specific to the engine, such as speed, temperature and the like. In addition, the idle stop, which fixes the idling throttle flap angle, is varied by means of a positioning motor as a function of the engine temperature and of further parameters. In this way, the idling speed is influenced or controlled. However, in the event of a malfunction, the throttle flap may be opened up to relatively large angles, resulting in considerable operational disturbances. The event of a malfunction may occur, for example, in the case of a short-circuit of a motor triggering line of the positioning motor to battery voltage or ground.

In order to be able to establish such malfunctions, the state of the equipment output terminals which serve to trigger the positioning motor of the idle stop could be monitored by means of appropriate circuit arrangements. A deviation from the desired state could be detected by a computer and corresponding counter measures could be initiated. The disadvantage of such a monitoring device is the additional circuitry and the occupation of inputs of the control, which could then no longer be used for other purposes.

U.S. patent application Ser. No. 410,586, filed on Sept. 21, 1989 discloses a method for controlling the idle speed of an engine via the position of the throttle flap. The angle of the throttle flap is changed with a movable idle stop of the flap in dependence upon operating parameters such as temperature, engine speed and alike with this change being such that the idle speed takes on a pregiven value determined from the operating parameters.

On the other hand, U.S. Pat. No. 4,622,936 discloses an electronic gas pedal in association with an electronic fuel controller for an internal combustion engine. The position of the throttle flap is determined in dependence upon the position of the accelerator pedal via a control arrangement and a positioning motor. For this purpose, a desired value for the throttle flap position is determined from the accelerator pedal and is compared with an actual value generated by a position transducer and corresponding to the actual position of the throttle flap. The position of the throttle flap is then changed in dependence upon this difference.

U.S. Pat. No. 4,452,200 discloses an idle speed control system which operates by adjusting the position of the throttle flap. A position desired value is formed in dependence upon operating parameters and is compared to a value determined from the position of the throttle flap and a motor is driven for changing the position of the throttle flap with the aid of the signal representing this difference. For detecting the non-idle speed condition, the throttle flap position value is stored in memory when the sign of the error signal changes into negative. The stored value is then compared with an actual position value and the non-idle speed condition can be detected if the difference between the stored and actual throttle flap value exceeds a predetermined threshold value.

Finally, U.S. Pat. No. 4,580,220 discloses a fail-safe emergency operation device for an idle speed control. In this device, the drive pulses of the positioning component influencing the idle speed is fed back to the control unit generating the drive signal. A comparison determines whether an error condition is present in the area wherein the drive signal is formed.

SUMMARY OF THE INVENTION

The system for setting the throttle flap angle according to the invention affords the advantage with respect to the foregoing that no additional circuitry is necessary, since a monitoring of the idling throttle flap angle takes place always when the throttle flap is in contact engagement with the idle stop, by a comparison of the actual throttle flap angle with the throttle flap angle measured when the throttle flap was last in contact engagement. For this purpose, the existing devices of the electronic control device can be used without additional circuit complexity.

By means of the buffer storage of earlier and actual throttle flap angles, it can also be monitored upon actuation of the positioning motor whether the positioning motor is moving the idle stop in the correct direction, namely in the direction of the desired value. Upon actuation of the positioning motor in the incorrect direction, a reversal of direction can be initiated immediately.

Even if an actuation of the positioning motor is established in spite of actual value/desired value match, it is sufficient to interrupt the malfunctioning control output or to connect it in-phase to a functioning output. In order to make possible a rapid malfunction detection, the actual value/desired value interrogation can take place cyclically at high frequency.

Such a reliability concept is especially applicable to positioning motors having a digital drive such as will be described in the description of the preferred embodiments.

BRIEF DESCRIPTION OF THE DRAWINGS

The invention will now be explained with reference to the drawings wherein.

DESCRIPTION OF THE PREFERRED EMBODIMENTS OF THE INVENTION

Figure 1:
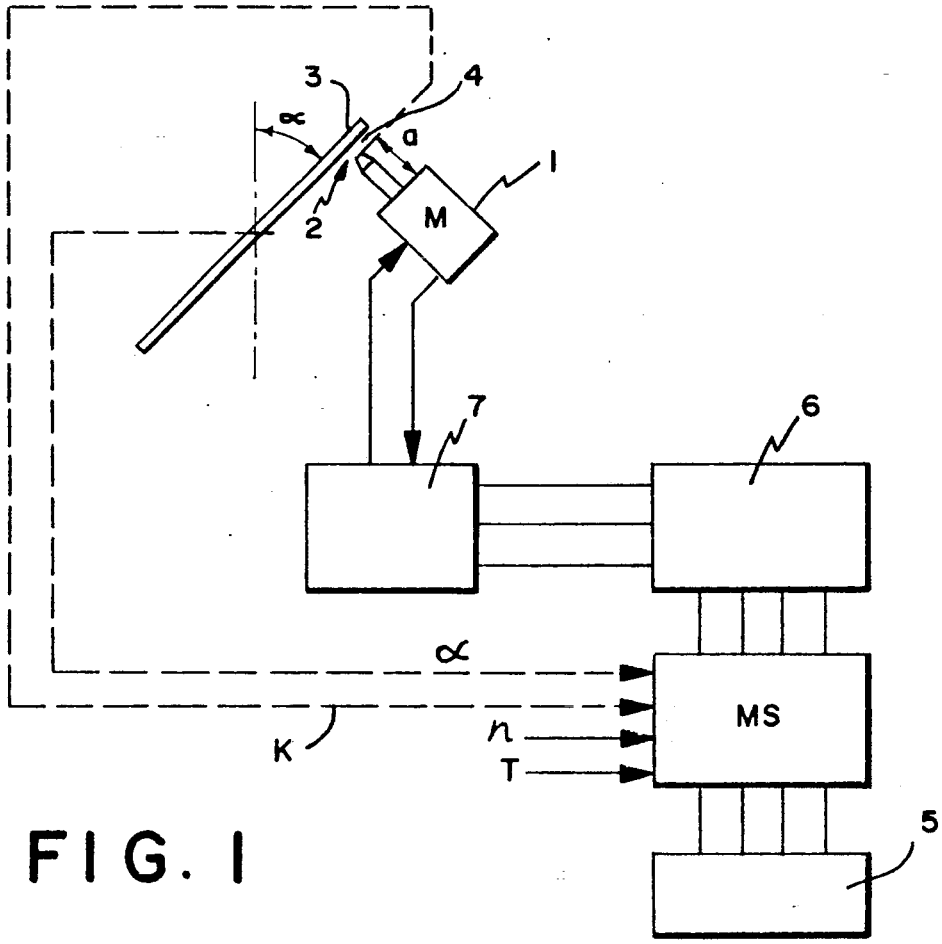
FIG. 1 shows the block circuit diagram of a system for setting the idle stop.

The block circuit diagram shown in FIG. 1 includes a positioning motor 1 for setting an idle stop 2. The idle stop 2 can be varied in arrow direction (a). A throttle flap 3 at the throttle flap angle $\alpha$ comes into contact engagement with the idle stop 2.

A motor control MS receives, at a plurality of control inputs, data on the engine temperature T, engine speed (n), the throttle flap angle $\alpha$ and, via a signal line K, the data whether the throttle flap 3 is in contact engagement with a contact 4 of the stop 2.

The motor control MS has access to a memory 5, in which desired values and actual values of throttle flap angles are stored. Via a motor control unit 6 and an output stage 7, the motor control MS actuates the positioning motor 1, to bring the stop 2 into the position required in each case.

The motor control 6 controls the movement of the positioning motor with the aid of a digital drive signal. This digital signal includes at least a two-position binary drive configuration. A standstill of the motor (11,00) or a forward or rearward movement of the positioning motor (10,01) is carried out in correspondence to the logic level of these two bits.

Figure 2:
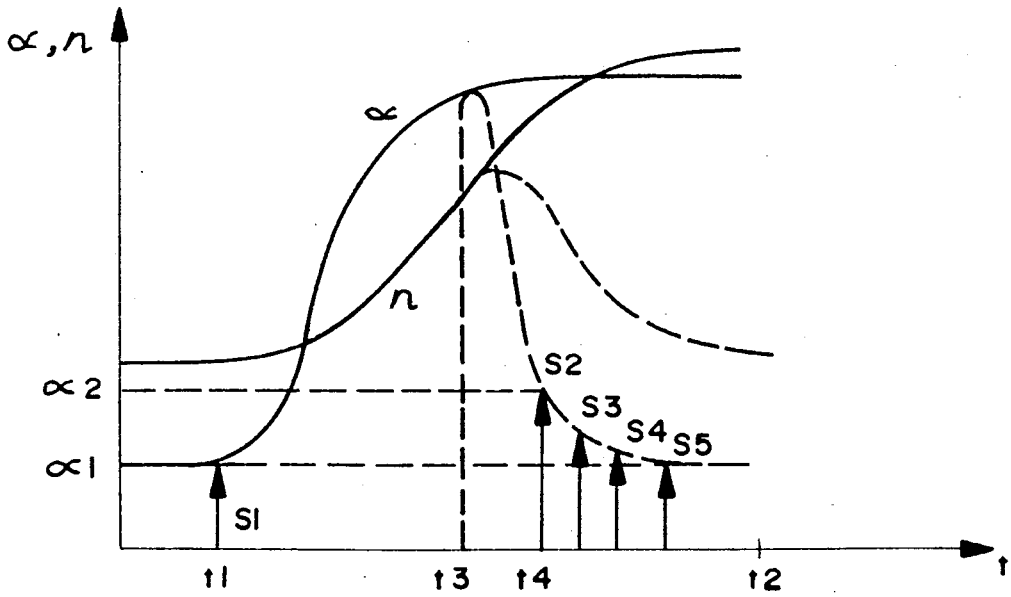
FIG. 2 is a diagram showing engine speed and throttle flap angle as a function of time; and, FIG. 3 is a flowchart for explaining the operation of the system for setting the throttle flap angle.

In the diagram shown in FIG. 2, the throttle flap angle $\alpha$ and the speed (n) are represented as functions of time. The position of the idle stop is indicated by vertical arrows S1 to S5. The solid lines for speed (n) and throttle flap angle $\alpha$ show the $\alpha$-n dependency, starting from idle at the time t1 up to the maximum throttle flap angle $\alpha$ at t2. The broken $\alpha$-n lines, on the other hand, indicate the case when the throttle flap angle $\alpha$ is reduced at a time t3 by a complete pullback on the accelerator pedal.

Upon opening of the throttle flap angle, starting from the time t1, the position of the idle stop changes by an appropriate adjustment from the position S1 into the position S2, in order to adjust to a higher idle speed for a short time upon a sudden pullback of the accelerator pedal. As soon as the throttle flap comes into contact engagement with the idle stop in the position S2, at time t4, the stop is changed in the direction of the position S1, since this position S1 represents the throttle flap angle $\alpha 1$ previously buffer-stored in the memory 5. The returning of the idle stop 2 into the position S5, which correspond to the position S1, can take place within a fraction of a second.

When the throttle flap 3 comes into contact with the idle stop 2 in the position S2, the contact 4 is actuated and, as a result, a measurement of the throttle flap angle $\alpha 2$ is initiated. This angle $\alpha 2$ is compared with the throttle flap angle $\alpha 1$, which was last measured and buffer-stored. Since there is a difference between the two values, the positioning motor 1 moves the idle stop 2 in the direction of the buffer-stored throttle flap angle $\alpha 1$. In the position S5, the idle stop 2 has reached the throttle flap angle $\alpha 1$, so that, at the time t5, the adjustment operation of the idle stop 2 is concluded.

As mentioned above, the movement of the positioning motor is controlled by at least a two-position binary number. If a malfunction occurs in one of the two signal lines conducting these data such as a short circuit to ground or a short circuit to the battery voltage, the possibility is then presented that the movement of the positioning motor is no longer controllable in an orderly manner. Accordingly, and because of a short circuit to battery voltage, the signal line conducting the signal for the forward movement can no longer carry out the movement in the rearward direction of the positioning motor even though the motor control 6 has determined the needed number combination therefor and has supplied the same.

If, because of a malfunction, the positioning motor 1 were to move in the incorrect direction, the motor control MS could detect, on the basis of the buffer-stored throttle flap angles, that there is a malfunction since the idle stop 2 is moving away from the correct throttle flap angle $\alpha$. The motor control MS could thereupon interrupt the actuation of the positioning motor 1 or initiate a reversal of direction.

In the embodiment shown, the desired value for the idle stop is the throttle flap angle $\alpha 1$. This desired value is changed by the motor control MS only with throttle flap 3 bearing against the stop 2 when there are changed operating conditions. If a new desired value is specified, the motor control MS can also monitor in this case whether the positioning motor 1 is moving the idle stop 2 in the correct direction, since the position of the idle stop 2 can be checked via the throttle flap angle $\alpha$ when the throttle flap 3 is making contact.

Figure 3:
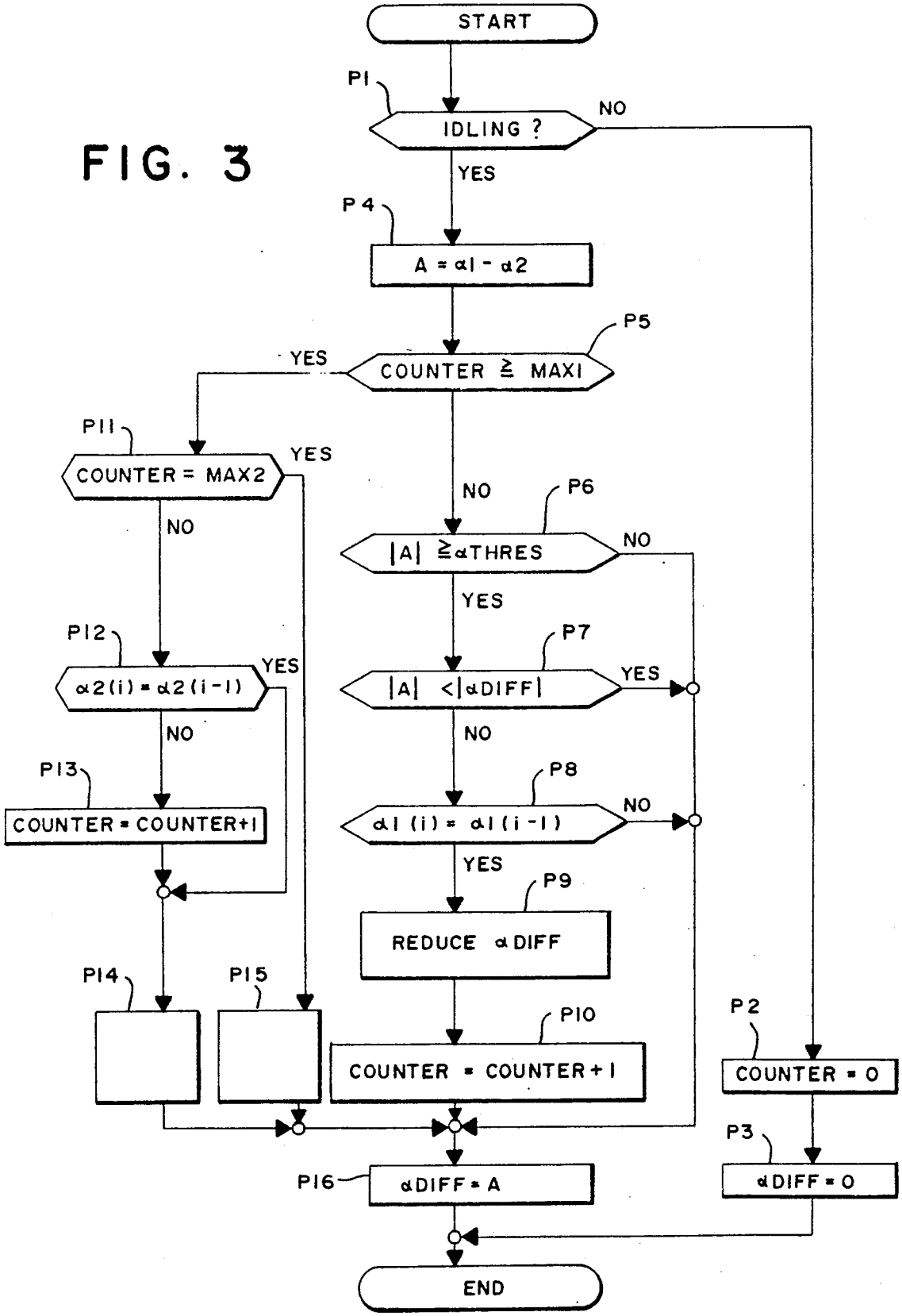

The function of the system according to the invention is explained with reference to the flowchart shown in FIG. 3. The flowchart shown in FIG. 3 comprises 16 program steps P1 to P16. The processing of the program steps takes place by the motor control MS (FIG. 1) in a fixed sequence.

In program step P1, it is first determined whether idle operation is present. If this is not the case, the RAM cells required for monitoring the positioning motor triggering, COUNTER and $\alpha$DIFF, which are stored in memory 5, are definitively set. This takes place in program steps (P2, P3).

In the RAM cell COUNTER, the positioning motor triggering pulses which have arisen in this program due to detected malfunctioning of the positioning motor are counted. $\alpha$DIFF contains the difference between the last throttle flap angle $\alpha 1$ measured and buffer-stored and the throttle flap angle $\alpha 2$.

In idle operation, according to program step P4, a value A is buffer-stored in the memory 5, the value A corresponding to the difference between $\alpha 1$ and the actual throttle flap value $\alpha 2$. In program step P5, a check is made as to whether the content of the RAM cell COUNTER is greater than or equal to the value MAX1. The value MAX1 corresponds to the maximum number of positioning motor triggering attempts with the requirement of reducing the difference between $\alpha 1$ and $\alpha 2$. If this value MAX1 is not yet exceeded, the interrogation takes place in program step P6 as to whether the amount of A is greater than or equal to a throttle flap threshold $\alpha$THRES. $\alpha$THRES represents a neutral zone in which no positioning motor triggering takes place. If the throttle flap difference newly calculated and interrogated in A is within this threshold, in program step P16, the value A is transferred to $\alpha$DIFF for the next processing sequence. If the neutral zone is exceeded, a check in program step P7 determines whether the amount of the actual difference has increased with respect to the amount of the difference from the previous processing sequence, stored in $\alpha$DIFF. If this is not the case, control goes to program step P16. In the other case, the actual throttle flap value $\alpha l(i)$ is compared in program step P8 with the throttle flap value $\alpha 1(i-1)$ from the last processing sequence.

This procedure excludes the condition that the throttle flap difference changes in response to a new throttle flap value $\alpha 1$ such that a malfunction is erroneously detected.

If $\alpha 1(i)$ does not equal $\alpha l(i-1)$, the program continues at program step P16. If they are equal, the positioning motor 1 is triggered in program step P9 such that the difference between $\alpha 1$ and $\alpha 2$ becomes smaller. In program step P10, the content of COUNTER is incremented. Subsequently, in program step P16, the newly calculated throttle flap difference of A is transferred to $\alpha$DIFF. If it is established in program step P5 that the content of COUNTER is greater than or equal to MAX1, the content of COUNTER is compared with MAX2 at P11. The difference between MAX2 and MAX1 corresponds to the maximum number of positioning motor triggering pulses for the "stopping the motor at high potential" triggering mode.

If COUNTER content equals MAX2, the attempt is made in program step P15 to stop the motor at low potential. Before the program could come to this triggering mode, it had already been attempted MAX1 times to trigger the motor such that the difference becomes smaller and it had been attempted (MAX2 −MAX1) times to stop the motor at high potential.

If COUNTER does not equal MAX2, it is additionally checked in program step P12 whether the throttle flap angle $\alpha 2(i)$ has changed with respect to the throttle flap angle $\alpha 2(i-1)$ from the previous processing sequence. If this is not the case, it may be assumed that the positioning motor is stationary and continues to remain stationary upon triggering at high potential. In the other case, the content of COUNTER is additionally incremented.

It is understood that the foregoing description is that of the preferred embodiments of the invention and that various changes and modifications may be made thereto without departing from the spirit and scope of the invention as defined in the appended claim.

What is claimed is:

1. A system for adjusting the angle of the throttle flap of an internal combustion engine, the system comprising:

an electronic device for controlling the throttle flap angle in dependence upon the position of the accelerator pedal and upon parameters specific to the engine;

an adjustable throttle flap idle stop for stopping the angular movement of the flap in an idle angle position defining a throttle flap angle value ($\alpha 1$) and corresponding to the idle operation of the engine;

memory means for buffer-storing said throttle flap angle value ($\alpha 1$);

a positioning motor connected to said electronic device and being adapted to adjust the position of said idle stop;

said electronic device including means for measuring the actual value of the throttle flap angle ($\alpha 2$) when said throttle flap is in contact engagement with said idle stop; and, comparison means for comparing said actual value ($\alpha 2$) with the buffer-stored throttle flap angle value ($\alpha 1$); and, said electronic device being adapted to issue a signal to said positioning motor for displacing said stop in the direction of the buffer-stored throttle flap angle value ($\alpha 1$) in response to a difference between said values $\alpha 1$ and $\alpha 2$.

2. The system of claim 1, wherein an actuation of the positioning motor is immediately interrupted when the throttle flap is in contact engagement with said idle stop provided that said idle stop is moving away from a position (S1) representing a desired value.

3. The system of claim 1, wherein the comparison in said comparison means takes place cyclically at high frequency.

4. The system of claim 1, wherein said parameters are engine speed and engine temperature.

5. The system of claim 1, wherein an actuation of the positioning motor is immediately interrupted and a reversal of direction is initiated when the throttle flap is in contact engagement with said idle stop provided that said idle stop is moving away from a position (S1) representing a desired value.

6. The system of claim 1, wherein a reversal of direction of the positioning motor is immediately initiated when the throttle flap is in contact engagement with said idle stop provided that said idle stop is moving away from a position (S1) representing a desired value.

7. The system of claim 2, wherein said electronic device is adapted to interrupt said signal to said positioning motor when said positioning motor is actuated to displace said stop in a direction away from said buffer-stored throttle flap angle value ($\alpha_1$).

8. The system of claim 2, wherein said electronic device is adapted to change the phase of said signal when said positioning motor is actuated to displace said stop in a direction away from said buffer-stored throttle flap angle value ($\alpha_1$).

* * * * *

UNITED STATES PATENT AND TRADEMARK OFFICE

CERTIFICATE OF CORRECTION

PATENT NO. : 5,046,467

DATED : September 10, 1991

INVENTOR(S) : Herbert Arnold, Michael Horbelt, Rüdiger Jautelat, Peter Werner, Manfred Mezger and Günther Plapp It is certified that error appears in the above-identified patent and that said Letters Patent is hereby corrected as shown below:

In the title page, under reference numeral [63]: delete "No. 202" and substitute -- PCT/DE88/00202 -- therefor.

In column 3, line 42: delete "correspond" and substitute -- corresponds -- therefor.

Signed and Sealed this

Sixth Day of July, 1993

Michael K. Kirk

*Attest:*

MICHAEL K. KIRK

*Attesting Officer*

*Acting Commissioner of Patents and Trademarks*